US007140275B1

(12) United States Patent
Staples

(10) Patent No.: US 7,140,275 B1
(45) Date of Patent: Nov. 28, 2006

(54) SEPARATE RATCHET DRIVEN C-WRENCH

(76) Inventor: Scott A. Staples, 132 Oak Ridge Rd., Kennebunkport, ME (US) 04046

( * ) Notice: Subject to any disclaimer, the term of this patent is extended or adjusted under 35 U.S.C. 154(b) by 0 days.

(21) Appl. No.: 11/489,405

(22) Filed: Jul. 19, 2006

(51) Int. Cl.
*B25B 13/02* (2006.01)
*B25B 13/48* (2006.01)

(52) U.S. Cl. ..... 81/119; 81/186; 81/DIG. 8

(58) Field of Classification Search ..... 81/119, 81/186, 176.1, DIG. 8
See application file for complete search history.

(56) References Cited

U.S. PATENT DOCUMENTS 1,512,559 A * 10/1924 Moore ..... 81/165
4,688,454 A * 8/1987 Scull ..... 81/119
4,774,862 A * 10/1988 Scull ..... 81/119
5,582,083 A * 12/1996 Baker ..... 81/119
5,671,644 A * 9/1997 Anderson ..... 81/119
5,931,063 A * 8/1999 Kuo ..... 81/119
6,334,375 B1 * 1/2002 Belcher ..... 81/176.1
6,805,029 B1 * 10/2004 Foster et al. ..... 81/186
6,912,936 B1 * 7/2005 Hume ..... 81/119
2004/0099100 A1 * 5/2004 Hu ..... 81/119

* cited by examiner

*Primary Examiner*—David B. Thomas
(74) *Attorney, Agent, or Firm*—William F. Hamrock, PA

(57) ABSTRACT

An open end C-wrench is provided having an open end C-wrench head driven by a conventional square ratchet extension tool. The open end C-wrench head has four flat surfaced jaws encompassed within a thin, narrow web body having a small square hole integrally centered therein. The jaws include two opposed unequal length, one short and one long, parallel drive jaws enclosing two adjoining equal length backup jaws. The four jaws squarely engage four continuous sides of the nut defined first, second, and third and fourth sides. When the wrench is in the drive position, the short drive jaw surface engages about fifty percent of the first side of the nut while the longer drive jaw engages about ninety percent of the fourth side of the nut while the two backup jaws coextend in secure engagement with the second and third sides of the nut. Greater driving torque is provided by the drive hole being integrally centered in the web body.

5 Claims, 2 Drawing Sheets

SEPARATE RATCHET DRIVEN C-WRENCH

BACKGROUND OF THE INVENTION

The invention relates to a separate ratchet driven wrench, and in particular, to a small open end C-wrench head having upper and lower engaging jaws encompassed within a narrow thin web body having an integrally located driving hole through which a driving tool drives the C-wrench head with increased ratchet torque. The ratchet tool is separate common ratchet square driving tool for loosening/tightening hexagon nuts and fasteners by means of turning a wrench head.

The present invention is a ratchet driven open end C-wrench designed by a plumber to assemble/disassemble kitchen, lavatory and deck mounted tub faucets. The unique narrow and thin design of the C-wrench head when used with a separate ratchet extension tool provides accessibility to faucet nuts that are often difficult to hold even when using many specialty wrenches. There are known separate ratchet driven wrenches but from my experience they do not work in tight areas. These separate ratchet driven wrench heads generally cannot operate in extremely confined plumbing areas because of their larger size and greater thickness of their web body. This requires a larger driving hole for the tool which is then a greater distance from the wrench jaws, all of which requires applying greater torque in operating the wrench heads because of their large size, greater thickness, and large driving hole located further distance from the jaws.

SUMMARY OF THE INVENTION

The C-wrench of the invention involves a C-wrench head with a separate handle for driving hexagonal nuts and fasteners. The C-wrench head has two parallel upper and lower driving jaws of different lengths enclosing two adjoining upper and lower backstop jaws encompassed within a narrow thin web body having an integral square drive hole which minimizes the size of the wrench head. In activating the hexagonal nut, the upper shorter jaw pulls on the nut while the lower longer jaw pushes on the nut. All jaws have flat surfaces which solidly engage the respective sides of the nut. The wrench head shorter upper jaw surface contacts about fifty percent of the first side of the nut. The adjoining upper backstop jaw surface contacts the entire surface of the second side of the nut. The adjoining lower backstop jaw surface contacts the entire surface of the third side of the nut. The adjoining lower longer jaw surface contacts about ninety percent of the fourth side of the nut.

The present C-wrench head provides a one directional having the driving jaws of the shorter upper jaw and the longer lower jaw applying torque to the engaging sides of the first and fourth sides of the hexagonal nut's exterior stronger pointed corners. By directing the torque pressure points to the stronger pointed corner surfaces of the nut and heavier surfaces of the nut, the impact of the torque is cushioned preventing damage to the nut surface.

The drive square hole is integrally located in the center of the widest areas of the wrench head's web body. This location provides the strongest point of contact on the wrench web body by aligning the drive square hole at a ninety degree angle with the intersecting point of lower backstop jaw surface where it adjoins the longer lower drive jaw surface. This position of the drive hole in the center of the widest area of the web body permits the greatest amount of torque to be applied to the hole by ratchet tool handle. Here, twisting of the tool handle which pushes and pulls the C-wrench head into the hexagonal nut surface occurs without damaging the nut or web body of the wrench head.

PARTS LIST

10 Open end C-wrench
12 C-wrench head
14 Square ratchet tool
16 Upper drive jaw
18 Lower drive jaw
20 Upper backstop jaw
22 Lower backstop jaw
24 Web body
26 Drive hole
27 Inward edge
28 Wide section of the web body
29 Aligned edge.
30 Hexagon nut
31 Outward side
32 $1^{st}$ side of nut
34 $2^{nd}$ side of nut
36 $3^{rd}$ side of nut
38 $4^{th}$ side of nut
40 Heavy corner of nut
42 Strong corner area

BRIEF DESCRIPTION OF DRAWINGS

The invention is described by the appended claims in relation to the description of the preferred embodiments with reference to the following drawings which are explained briefly as follows:

DETAILED DESCRIPTION OF THE DRAWINGS

Figure 1:
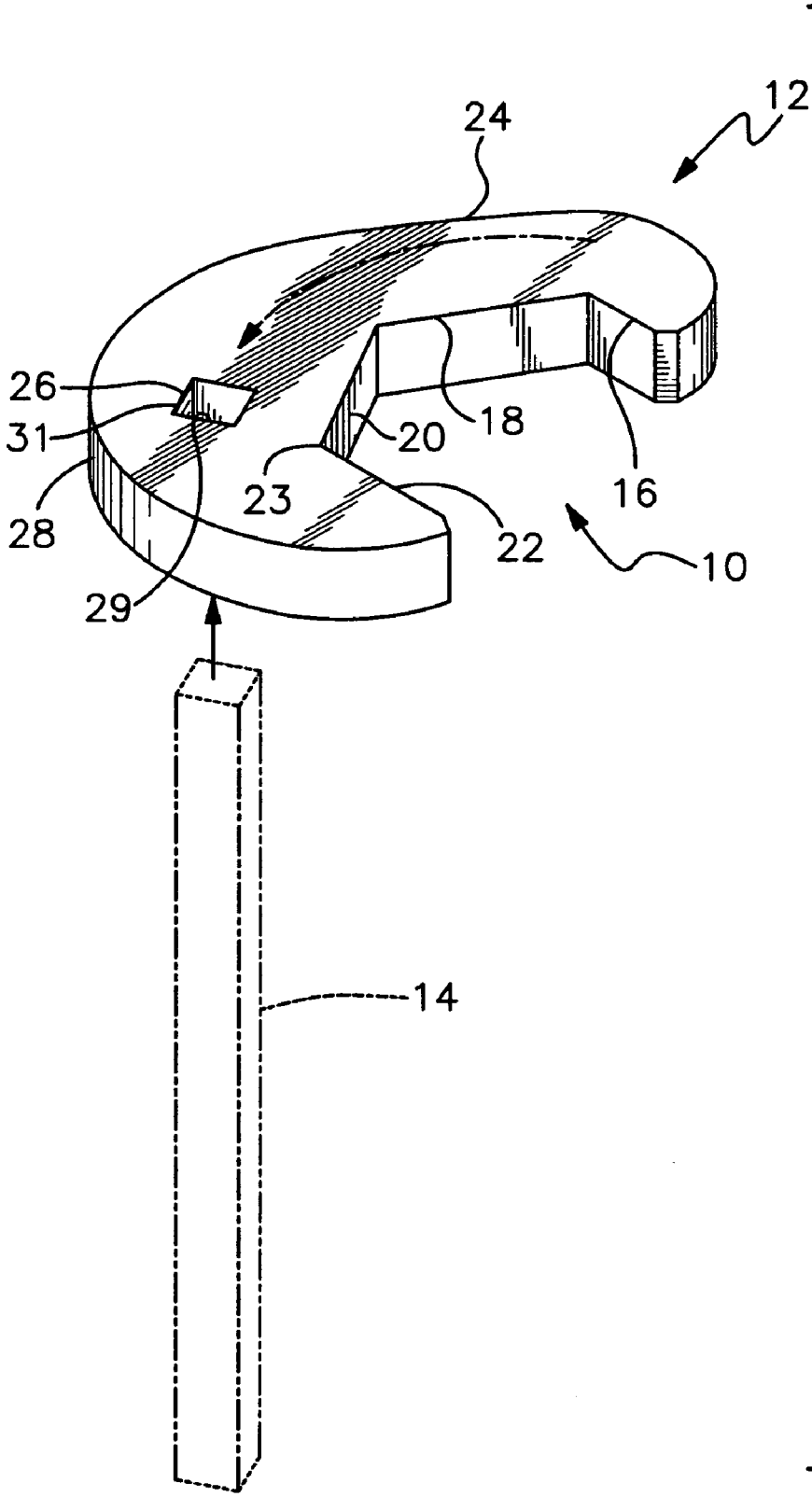
FIG. 1 is a top side view of the open end C-wrench head of the wrench of the invention.
Figure 2:
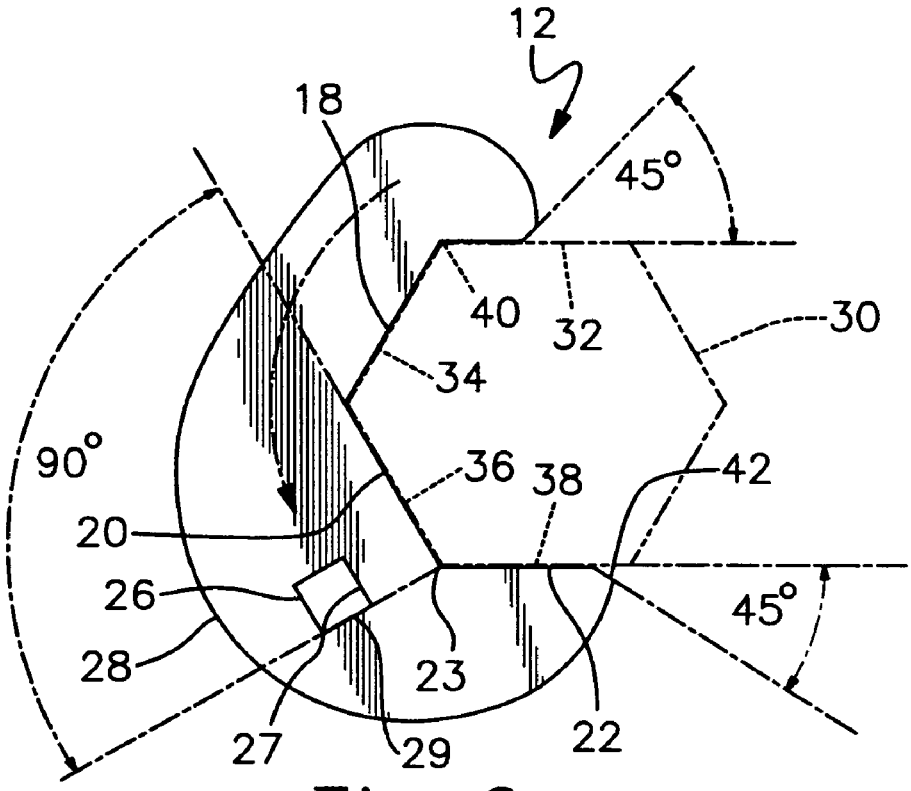
FIG. 2 is a top plan isometric view of the open end C-wrench head shown with a nut in the drive loosening position.
Figure 3:
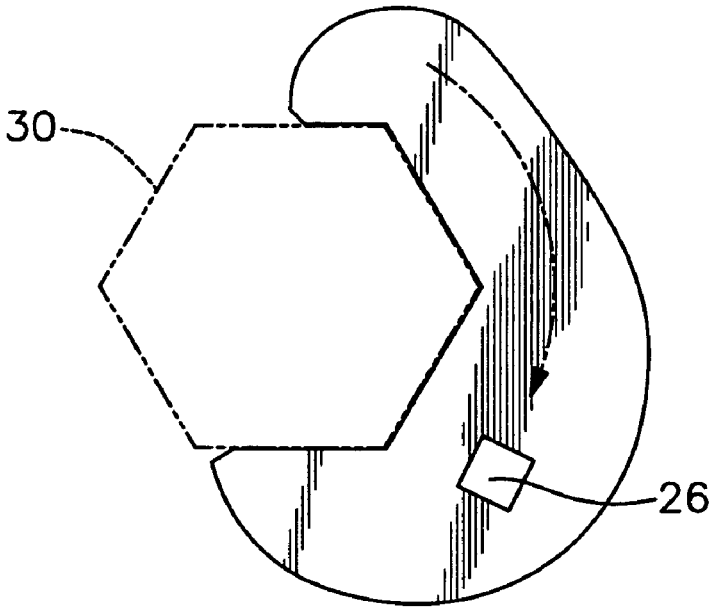
FIG. 3 is a top plan view of the wrench head with the nut in a tightening position.

Referring to the drawings, FIG. 1 is a top side view of an open end C-wrench having an open end C-wrench head 12 in the form of the letter "C", and a separate conventional square ratchet extension tool 14 which is commonly used with handleless open end wrenches having square driving holes as depicted in FIGS. 1, 2 and 3.

The present open end C-wrench head 12 has a one piece open end dimensioned to tightly engage a one size hexagonal member such as hexagonal nuts 30, as seen in FIG. 2, and fasteners, Open end head 12 has four internal flat surface jaws defined by two unequal length parallel upper drive jaw 16 and lower drive jaw 22, and two enclosed adjoining upper backstop jaw 18 and lower backstop jaw 20. The four drive and backstop jaws are encompassed within a thin, narrow web body 24 having a small square drive hole 26 located in the center area of the widest section of the web 28.

Shown in FIG. 2 is a wrench head grasping hexagonal nut 30. Flat side 32, 34, 36 and 38 of the nut are securely engaged by the flat surfaces of respective jaws 16, 18, 20 and 22 of the wrench head. In the loosening drive position, with the square ratchet tool 14 operating through drive hole 26, upper jaw 16 pulls on engaged nut side 32 and lower drive jaw 22 pushes on nut side 38 twisting the nut counter clockwise while backup jaws 18 and 20 coextend in secure contact with nut flat sides 34 and 36. Since short upper drive jaw 16 engages only the lower fifty percent of the first side of nut 32, pulling torque is applied to the lower fifty percent side of bottom half of nut 32, pulling torque is applied to the lower fifty percent side of bottom half of nut side 32 extending to the thicker corner 40. Since long lower parallel jaw 22 engages about ninety percent of the nut flat side 38, pushing torque is applied to nut side 38 extending to its thicker stronger corner area 42.

With the driving ratchet tool 14 operating in integrally positioned square hole 26, centered in wide web body area 28 positioned within the ninety degrees angle area below the lower backstop jaw 20, sufficient but less driving torque need be applied to wrench head 12 through upper drive jaw 16 and lower drive jaw 22 to nut 30. The less but sufficient driving torque is provided through drive hole 26 since it is integrally centered in the wide body section 28 of the largely narrow web body 24 making hole 26 being centered very close to the inward and outward edges of the wide web body. The position of the drive hole is that the hole inward side 27 is located very close to the surface of lower backup jaw 20 at its intersecting point 23, where it intersects with lower drive jaw 22, with the hole inner side 29 directly aligned with point 23 in a ninety degree angle, and with the hole outward side being positioned very close to the outer edge 33 of the wide web body 28.

It is because of the web body being small, narrow and thin, as compared to other wrench heads, that the smaller driving hole 26 can be located centrally so close to the hexagon nut 30 where less torque need be applied by an even smaller, and easier to use, square driving tool to drive the nut. It is because of these features, that the present open end C-wrench head can be used in tight areas when other conventional wrenches cannot be used. The, about forty five degree angle, tip ends of upper drive jaw 16 and lower drive jaw 22 make it easier to fit the hexagon nut within wrench head 12 without scratching the nut.

Generally, for standard hexagon nuts of about one and five sixteenth inches wide, best results have been obtained when the drive hole is about one quarter to five sixteenth inch square, the equal distance between the drive hole and the outward edge of the wide web jaw is about one quarter inch to five sixteenth inch. For smaller and larger hexagon nuts, generally between one half inch to two inches wide, the dimensions of the C-wrench will be proportionate in size.

While the invention has been illustrated and described in detail in the drawings and foregoing description the same is to be considered as illustrive and not restrictive in character. It being understood that only the preferred embodiments have been shown and described and that all changes and modifications that come within the spirit of the invention are desired to be protected.

What is claimed is:

1. An open end C-wrench for driving a hexagon nut in an open end C-wrench head driven by a conventional separate square ratchet driving tool in the drive position, the open end C-wrench head comprising:

first and second upper jaw and third and fourth lower jaws rigidly joined together having surfaces which continuously squarely engage four sides of the hexagon nut being driven when the wrench is in the drive position, the jaws being encompassed within a narrow web body having a wide area within which a small square driving hole centrally centered therein, the surface of the first upper drive jaw sized to squarely contact about fifty percent of a first side of the nut, the surface of the second upper backup jaw that adjoins the first upper drive jaw sized to squarely contact an entire second side of the nut adjacent to the side of the nut, the surface of the third lower backstop jaw that adjoins the second backstop jaw sized to squarely contact an entire third side of the nut adjacent to the second side of the nut, the surface of the fourth lower drive jaw that adjoins the third lower backstop jaw sized to squarely contact about ninety percent of a fourth side of the nut adjacent to the third side of the nut, wherein the wide web body area is located below the third backstop jaw, wherein the square driving hole is centered in the wide web body below the surface of the third lower backstop jaw aligned within a ninety degree angle of the intersecting point of the surface of the lower back stop jaw where it adjoins the fourth lower drive jaw.

2. The open end C-wrench of claim 1 wherein the centered square driving hole is equidistance from the surface of the third lower backstop and from an outward edge of the wide web body area.

3. The open end C-wrench according to claim 2 wherein the centered driving hole is one quarter to five sixteenth square inch hole.

4. The open end C-wrench according to claim 3 wherein the driving hole is located about one quarter of an inch from each of the surfaces of the lower backstop and from the center of the outward edge of the web body area.

5. The open end C-wrench according to claim 4 wherein the web body has a thickness of about one quarter to five sixteenths inch.

* * * * *